US005738036A

United States Patent [19]

Jones

[11] Patent Number: 5,738,036

[45] Date of Patent: Apr. 14, 1998

[54] PLATFORM AND SUPPORTING STRUCTURES FOR A BOAT

[76] Inventor: Nathan Jones, 2436 W. 500 S., Salt Lake City, Utah 84104

[21] Appl. No.: 841,350

[22] Filed: Apr. 30, 1997

[51] Int. Cl.[6] ..... B63B 35/14

[52] U.S. Cl. ..... 114/255; 210/776; 119/2

[58] Field of Search ..... 114/255; 210/776, 210/242.1; 119/2; 43/6.5

[56] References Cited

U.S. PATENT DOCUMENTS

| | | | |
|---|---|---|---|
| 1,591,024 | 7/1926 | Dodge . | |
| 2,330,508 | 9/1943 | McColl . | |
| 2,804,045 | 8/1957 | Scott . | |
| 2,832,168 | 4/1958 | Brown . | |
| 2,920,606 | 1/1960 | Anderson . | |
| 2,984,207 | 5/1961 | Drake . | |
| 3,029,784 | 4/1962 | Elbreder et al. . | |
| 3,086,497 | 4/1963 | Novello . | |
| 3,534,859 | 10/1970 | Amero et al. . | |
| 3,604,395 | 9/1971 | Huslin . | |
| 3,661,263 | 5/1972 | Peterson et al. . | |
| 3,669,074 | 6/1972 | Stasio . | |
| 3,673,986 | 7/1972 | Braunhut . | |
| 3,678,899 | 7/1972 | Lovitz . | |
| 3,700,108 | 10/1972 | Richards . | |
| 3,700,109 | 10/1972 | Lasko . | |
| 3,745,115 | 7/1973 | Olsen . | |
| 3,768,193 | 10/1973 | London . | |
| 3,783,316 | 1/1974 | Stasio . | |
| 3,815,751 | 6/1974 | Pavlovic . | |
| 3,923,661 | 12/1975 | Crisafulli . | |
| 3,938,274 | 2/1976 | Seymour | 114/255 |
| 3,970,556 | 7/1976 | Gore . | |
| 4,006,082 | 2/1977 | Irons . | |
| 4,117,726 | 10/1978 | McGroddy . | |
| 4,205,626 | 6/1980 | Muchmore et al. . | |
| 4,264,444 | 4/1981 | Bronnec . | |
| 4,405,458 | 9/1983 | McHugh, Jr. . | |
| 4,458,621 | 7/1984 | De Clifford . | |
| 4,788,928 | 12/1988 | Tauber et al. | 114/255 |
| 4,839,062 | 6/1989 | Sanders . | |
| 4,996,780 | 3/1991 | Goe . | |
| 5,457,908 | 10/1995 | Sanders . | |
| 5,491,922 | 2/1996 | Sanders . | |
| 5,513,462 | 5/1996 | Lamon . | |

*Primary Examiner*—Stephen Avila
*Attorney, Agent, or Firm*—M. Reid Russell

[57] ABSTRACT

A platform for mounting to extend outwardly from a boat side or end and positioned in a body of water that is for use in harvesting of material, particularly brine shrimp eggs, off from the water surface and includes an arrangement for maintaining positioning of the platform during use by a worker or workers standing on a platform deck. The platform includes at least one port formed through an upstanding wall that the workers direct a slurry of materials into, with the port connecting, through a harvesting manifold, to a harvest pipe wherethrough the slurry is pulled by a pump, and directs it into porous bags. The harvesting manifold is mounted to the platform by brackets that also provide connection points for journaling a vertical boom roller therebetween. The platform includes at least one guide means, and preferably a pair of guide means, that is preferably a section of channel, and is secured along one side to extend across and vertically from top to bottom of a platform rear wall that is to fit into and through a bracket mount that is secured to extend outwardly from the boat, and includes a pin arrangement for securing, at a selected platform depth in the water, the guide channel in the bracket mount. A winch that is operated to reel a winch cable in or out that can selectively be attached to the platform, for assisting in lowering it into and raise it out from the water surface, or can be strung to move the collection boom across each boom roller, and including pulleys mounted to the boat to direct the winch cable to perform these functions, and further including a horizontal roller journaled across an edge of the boat for support the platform as it is lowered into and raised out from the water.

12 Claims, 6 Drawing Sheets

PLATFORM AND SUPPORTING STRUCTURES FOR A BOAT

BACKGROUND OF THE INVENTION

1. Field of the Invention

This invention relates to platforms for mounting to boats and in particular to work platforms for attachment to a boat bow, stern, or sides that can be conveniently lowered into and raised out from a body of water.

2. Prior Art

The platform of the invention is arranged for lowering off from a bow or side of a brine ship egg collection boat to serve as a work platform for a worker or workers to stand upon to draw sections of a cake of brine shrimp eggs as have been collected by booming operations from the surface of a body of water, such as the Great Salt Lake located in Utah. In such collection operations a boom is positioned around a slick of brine shrimp eggs as are found floating on water surface, and that boom is drawn in to shorten the area encompassed by the boom. Drawing in of which boom is accomplished by boats, then by hand, and finally by winching at least one boom around a pair of rollers journaled to the platform sides to shorten the boom diameter so as to draw the eggs into a compact mass, or cake. In such booming the egg cake is compacted from a very shallow depth to a typical thickness of from 6 to 12 inches. With the collected eggs to exhibit a significant density and stiffness. The compacted egg cake is drawn to the platform of the invention that has a working surface or deck that a worker or workers stand upon and is submerged in the water, below the cake bottom. The worker or workers standing on the deck, each use a rake, or the like, to draw sections of the cake onto the platform and thereon break up the cake sections, as with their feet, and mix it with water to form a slurry. The slurry is then passed into drain ports that are located in opposing sides of the platform and are at right angles to the platform deck. The drain ports connect to hose ends whose opposite ends connect to a pump or pumps that pull the egg and water slurry therethrough. The pumped slurry passes through a manifold system and is directed into porous bags. The bags maintain the eggs while allowing water to pass through the bag and back to the lake.

The weight and ergonomics the platform of the invention that two workers can manipulate the platform in and out of place, and provides means for worker safety in rough or clam water. A winch and horizontal roller arrangement are provided for supporting the platform for assisting in lowering the platform into and raising it out from the lake, the platform includes rails that are maintained in rollers of a bracket structure that is mounted onto the side of the boat, preferably at its bow. In practice the platform is maintained on the boat deck during travel to an egg slick. The platform is connected to a winch cable and is guided by at least one worker across the horizontal roller, with its rails fitted through the bracket rollers, and the platform lowered into the water. Whereat, the platform is maintained by a fitting of pins through spaced holes formed through the rails that pass under a bracket roller. The platform with the weight of a worker or workers thereon is supported on the pins and collected sections of egg cake are pulled thereon and mixed with water into a slurry that is passed into the side platform drain holes.

Of course, platforms arranged to be mounted onto the side of a boat that are removal when not in use are not new, as for example a water ski platform. Heretofore, however, a work platform and support structure that is readily and safely positionable and can be locked in place to a side of a boat for use in brine shrimp egg harvesting has not been available. Also unique to the invention is a platform that can be quickly and safely lowered into the water upon reaching a location of an egg slick, with that platform being easily positionable to a desired depth where it is locked in place to support the weight of a worker or workers standing thereon as they rake sections of collected egg cake onto the platform. Developments in brine shrimp egg harvesting have included skimming devices like that shown in a U.S. Pat. No. 4,839,062 issued to a Bruce Sanders that shows a vessel arranged to be moved slowly through a slick or streak of brine shrimp eggs to collect a slurry of water and eggs for pumping into porous bags, with later U.S. Pat. Nos. 5,457,908 and 5,491,922, also issued to Bruce Sanders, showing, in the '908 patent, a vessel for travel through water for skimming that involves a system of parallel conveyors to pull lift brine shrimp eggs into a catchment area for pumping into porous bags with the '922 patent showing a telescoping floatation boom for use with the vessel of the '908 patent.

Additionally, in the area of brine shrimp egg harvesting, a recent U.S. Pat. No. 5,513,462 was issued to Lamon that sets out a vessel and floating boom assembly, with another U.S. Patent issued also to a Soul-Sun Goe, for apparatus for brine shrimp egg drying. None of which patents, however, shows a platform like that of the invention.

Further in the area of vessels for skimming, particularly for skimming oil off from water, oil skimming vessels are shown in U.S. Pat. No. to Dodge, 1,591,024; to Richards, No. 3,700,108; to Bronnec, No. 4,264,444; and to Clifford, No. 4,458,621. Also, boat or float arrangements for collecting oil, or the like, off from water are shown in U.S. Pat. No. to Crisafulli, 3,923,661; to Gore, No. 3,970,556; to Irons, No. 4,006,082; and to MeGroddy, No. 4,117,726. With other arrangements and float devices for removing oil off from water shown in U.S. Pat. No. to Amero, et al., 3,534,859; to Peterson et al., No. 3,661,263; and to Pavlovic, No. 3,815,751, with an Archimedean Screw type pump arrangement shown in U.S. Pat. No. 3,768,193 to London that is for harvesting brine shrimp. None of which devices shows a platform like that of the invention.

While skimming devices for use with a boom or booms for collecting material, such as bring shrimp eggs or oil, off of a surface of water as set out above, are not new, none have provided, as does the invention platform guide a platform and winch arrangement for rapidly and conveniently moving the platform off from a vessel deck of position and maintaining it hanging from the vessel bow at a selected depth. Further unique to the invention is a boom guide arrangement that facilitates drawing in a boom positioned to encircle a slick of brine shrimp eggs, providing for a passing of the boom over rollers that are fixed to the platform sides, by operation of a same winch as is used against in raising and lowering the platform.

SUMMARY OF THE INVENTION

It is a principal object of the present invention to provide a platform and supporting structure for mounting onto a vessel that can be guided from the boat deck into the water to a desired position by hand and using a single winch and pulley and whereat the platform is secured by a pin mounting to the boat bow.

Another object of the present invention is to provide, a platform, that includes vertical rollers journaled to opposite platform sides wherearound a boom is passed that, when pulled at one end by a pulley and cable arrangement operated by the single winch, and with the other boom end attached to the platform rear, provides for boom closure to concentrate brine shrimp eggs within the boom into a cake that a worker standing on the platform deck can then break bergs off from and mix the bergs with water on the platform deck, forming a slurry, that is passed through ports in the platform side walls and is pumped to porous collection bags as are maintained on the boat.

Another object of the present invention is to provide a horizontal straight roller that is journaled across the boat bow supports the platform on the winch cable, as it is moved thereacross, and including platform guides secured across a platform rear wall that are in parallel straight sections of channel whose sides are to fit between slots of rollers that are maintained in brackets secured to the boat bow, to guide and support platform travel during platform lowering and raising into and out of the water.

Still another object of the present invention is to provide pulley systems with the boat whereby, a single winch and cable arrangement can be used for both aiding platform lowering and raising, and for attachment to drawing the boom, to shorten the diameter of an area within the boom.

Still another object of the present invention is to provide a platform arranged for transport on a boat deck to a section of a body of salt water where a streak or slick of brine shrimp eggs has been discovered and thereat can be quickly and safely lowered into the water to an appropriate depth, that the platform is maintained at utilizing lock pins, the platform including a flat deck as a stable work platform for supporting one or more workers who are engaged in harvesting brine shrimp eggs, with platform to be quickly and easily retrieved from the water and returned to its stowed attitude on the boat deck.

Principal features of the present invention in a platform and supporting structure for use in harvesting brine shrimp eggs where a boom is utilized for concentrating the eggs into a cake. The platform that is formed from a light weight strong material, such as a ⅛" plate aluminum, that is welded together, and includes a flat bottom surface or deck. Platform parallel side walls are secured at right angles to the deck surface along opposing edges and a rear wall is secured, also at a right angle, to the deck surface rear edge, and to the edges of the side walls, forming a box that is open across the top and a front face. A pipe or bar safety railing, that is bent into a U-shape and includes parallel legs that extend at right angles from ends of a web center section, is preferably secured along end sections to the side wall forward edges, as by welding. A lifting tab, that has a center hole formed therethrough, is secured to extend upwardly from the center of real wall, at or proximate to the rear wall top edge. Which tab hole is to receive a hook end of a winch cable, attached thereto, the winch cable to support lowering the platform into and raising it out of a body of water.

A horizontal roller is journaled to extend across the boat bow that is to receive and support the platform it is manually positioned thereon, which platform, at the tab hole, is connected onto the hook end of the winch cable for providing a safety arrangement for lowering the platform into and raising it out from the water. For guiding platform travel into and out of the water, a pair of brackets are secured to the boat bow to be perpendicular to the boat deck and parallel one another, and each bracket includes a pair of parallel plates that are open therebetween. At least one pair of rollers is maintained between the bracket parallel plates. An outer roller of each pair of rollers is mounted to an outer bracket plate and the inner roller of each pair is journaled between the plates. Preferably, at least top and bottom pairs of rollers are arranged with each bracket. A pair of channels are each secured along one side each to the platform rear wall to be parallel to one another. The rollers of each pair of rollers align with one another and are spaced apart to pass a side of each channel therebetween. Which channels thereby pass between and are guided by the bracket rollers as the platform is lowered into and raised out from the water.

In practice, to lower the platform is lowered by hand, it with the winch cable hook end connected thereto as a safety wire. A winch turns the winch cable off of the winch reel, while a worker or workers both lowers the platform and guides the bottom end of each of the channels through the top ends of the brackets. Thereby, the channel sides of each pass through the space between the pairs of rollers, guiding the platform as it is moved up or down. Tension on the winch cable can be used to maintain the platform to the boat bow at a desired position of that platform relative to the water surface. Further, to brake or stop travel of the platform channels through the brackets, pins can be fitted across through aligned holes formed through the channel top ends that engage the bracket top ends. Which pins can also be repositioned through another pair of channel holes when the platform is lifted. Thereat, the pins are fitted through pairs of spaced holes formed through the channel sides to pass below an outer roller of the pair of bracket rollers. So arranged, the pins to support the platform to the boat bow end. After pinning, the winch cable hook can be removed out from the tab hole and a worker or workers can move onto the platform deck.

A system of pulleys is also provided adjacent to and at the boat bow and deck edge for guiding the winch cable. Each pulley system is for directing a pulling force through the winch cable to either raise or lower the platform, or to urge one side of a boom across one of the vertical rollers journaled to opposite sides of the platform.

The boom as is used to concentrate a slick or brine shrimp eggs, includes a floating top portion that extends out of the water with a skirt that extends downwardly therefrom. In operation, after the boom is pulled in as by a use of boats, as a final concentrating step, with one boom end attached to the back of the platform rear wall, the other boom end is passed one or the other of the vertical rollers, forming a loop. In practice, the boom is pulled across the vertical pulley as by moving a boom boat and with a hook end of the winch cable passed through a port or starboard system of pulleys on both sides of the boat bow, the hook is attached to the boom at an eyelet formed in a section of the boom outer wall. The winch is then operated to wind in the winch cable so as to relieve tension on that section of the boom through the vertical pulleys, during shortening of the boom radius to concentrate a mass of brine shrimp eggs contained within the boom circle. This process is repeated, with the winch cable hook end attached at intervals along the boom and pulled in as the boom boat is moved, until the boom is pulled into a tight circle across to the boat bow. Thereat, workers, standing on the platform, break off sections, known as bergs, of the brine shrimp eggs that have been concentrated into a cake, that are drawn onto the platform deck. Whereat, the workers, stomping the mass with their feet and using hand tools, mix the berg materials with water into a slurry that is directed through ports formed in the platform side walls. The ports connect to hose ends that, in turn, connect to pumps that pull the slurry therethrough and discharge it through a manifold into porous bags maintained on the boat deck. The bags are maintained in an upright attitude in stands whereby water from the slurry will drain therefrom, leaving a concentration of brine shrimp eggs. Filled bags are removed from the stands, and their ends are closed for movement to a storage area.

DESCRIPTION OF THE DRAWINGS

In the drawings that represent the best mode currently contemplated for carrying out the invention.

DETAILED DESCRIPTION

Figure 1:
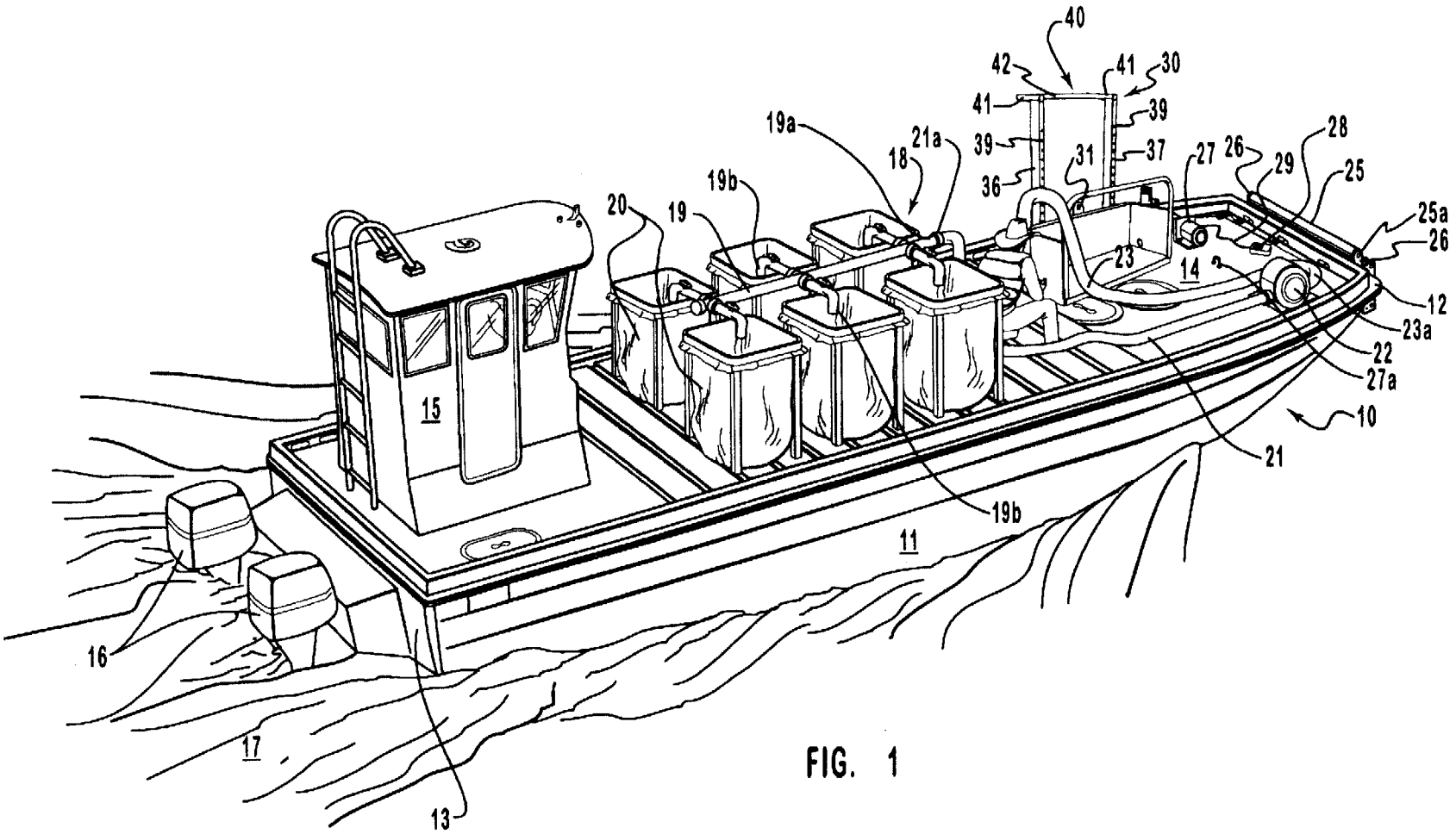
FIG. 1 is a side elevation perspective view of a brine shrimp harvesting boat shown traveling over the surface of a body of water, and showing a platform of the invention maintained on the boat deck along with a worker, whereon is mounted brine shrimp egg harvesting pump and hose and winch, and showing a horizontal roller of the supporting structure of the invention journaled across the boat bow.

FIG. 1 shows a boat 10 that, it should be understood, is preferably a brine shrimp egg harvesting boat 10, and includes a hull 11 with a bow 12 and stern end 13 and includes a flat deck 14. A pilot housing 15 is mounted on a stern section of the deck wherein an operator controls operations of a pair of outboard motors 16 that drive the craft through water 17. A manifold system 18 is mounted to a mid-section of the deck 14 that includes a plurality of interconnected pipes or tubes 19 that open to fill bags 20 maintained in bag stands with a slurry of brine shrimp eggs and water.

The slurry is introduced into the manifold system 18 through a tube or hose 21 that is connected on one end **21*a* to an open end 19*a* of a center tube 19, with the other hose end 21*b* fitted to an outlet side of a vacuum pump 22. The inlet side of the vacuum pump 22 connects to an end 23*a* of a first vacuum line 23, whose opposite end 23*b* connects to an outlet 46*a* of a flow manifold 45 the manifold 45 receives an egg and water slurry that is pulled in during harvesting through a port 53 formed through a platform side wall 33*a* or 33*b*. While a single vacuum line 23 is shown, it should be understood that two such vacuum lines can each be connected to the vacuum pump 22 from each of the ports 53, with each port 53 including a harvesting manifold 45. The ports 53, as shown, are each open through platform side walls 33*a* and 33*b* to the platform work area, just above platform deck 32**.

A harvesting platform 30, hereinafter referred to as platform, is shown in FIG. 1 maintained on the vessel deck 14 during travel to a harvesting site. Thereat, the harvesting platform 30 is positioned on a horizontal roller 25 that is journaled at pin ends **25*a* to parallel brackets that are secured to extend upwardly from the deck 14 forward edge, above bow 12. The platform 30, as shown, includes a lifting tab 31 extending upwardly from the center of an upper edge 34*a* of a rear wall 34 that has a hole 31*a* formed therethrough to receive a hook end 27*a* of a winch cable 27. The winch 21 is operated by an operator on the deck 14 with their foot that engages a foot peddle 28 that is connected to the winch through an electrical cable 29. An operator can thereby observe travel of the platform 30 taking up slack on the cable as one or more other workers manually guide platform lowering into or raising out from the water 17, or for winching in a boom 65**, as set out and discussed hereinbelow with respect to FIGS. 2 and 6.

Figure 3:
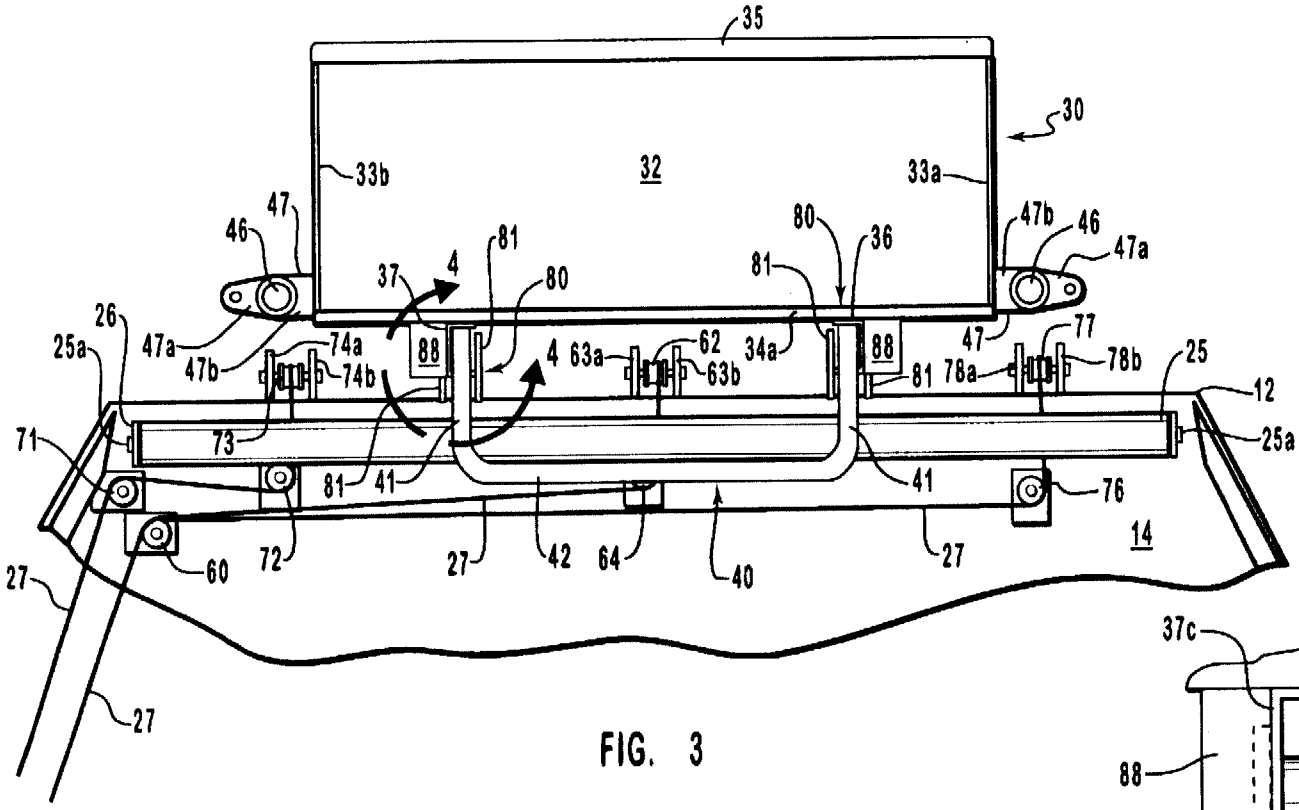
FIG. 3 is an enlarged top plan view of the platform maintained to the boat bow of FIG. 2, less the boom.
Figure 5:
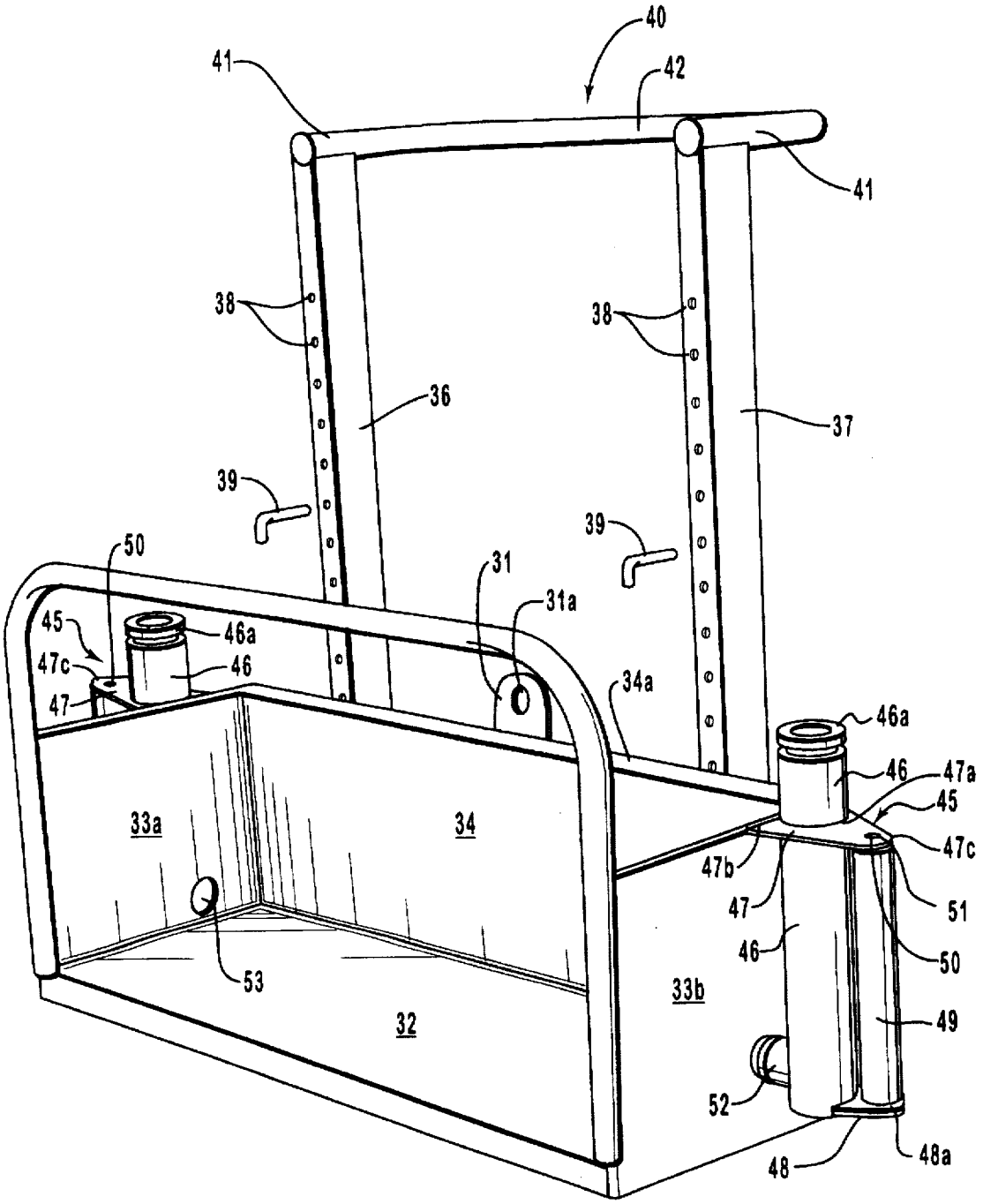
FIG. 5 is an enlarged side elevation view of the of the platform of FIG. 3 dismounted from the boat bow.
Figure 6:
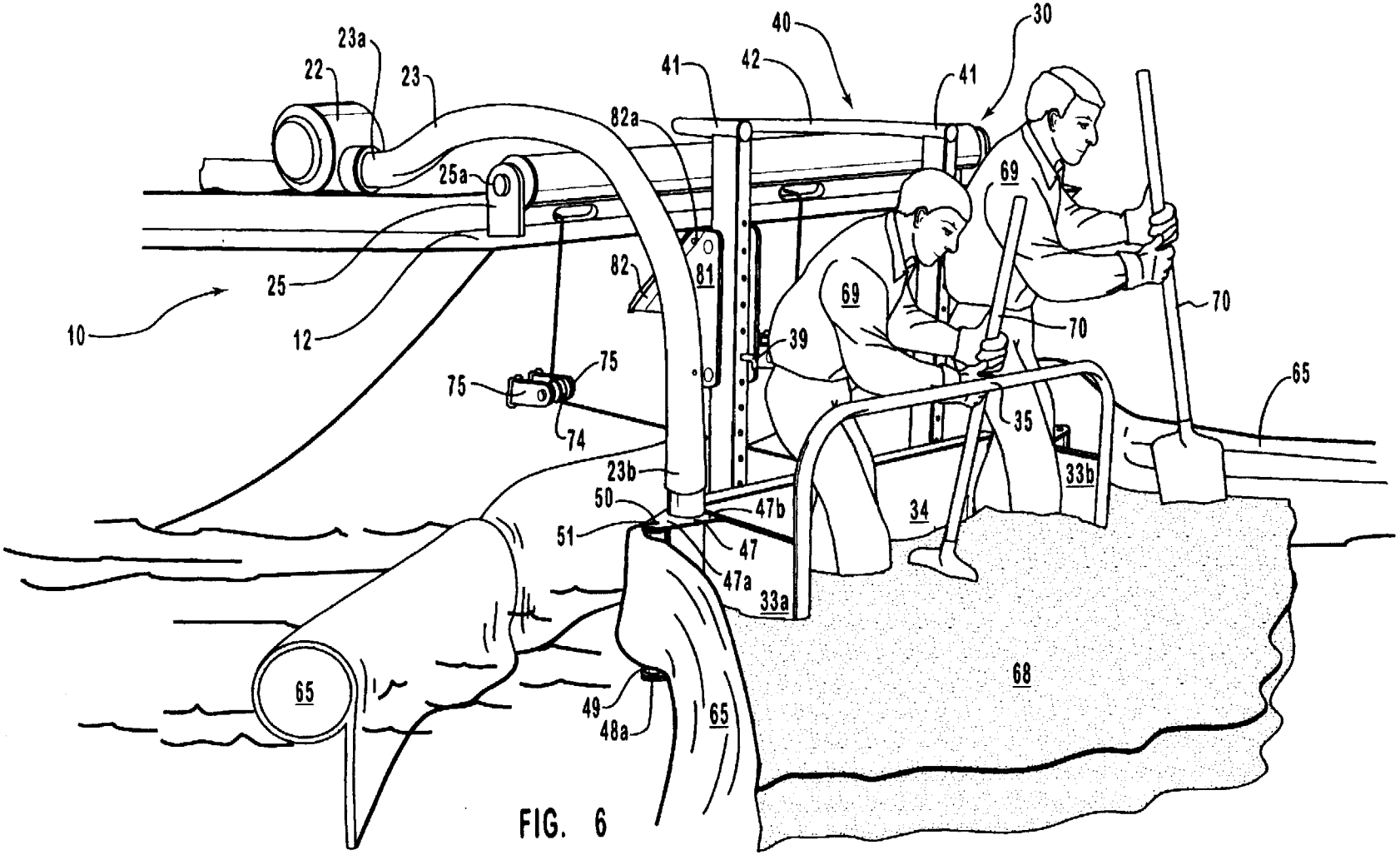
FIG. 6 is a sides elevation view of the platform of FIG. 5 shown maintained to the boat bow, with the boom of FIG. 2 shown connected thereto that has been drawn in to collect a cake of brine shrimp eggs, and showing a pair workers standing on a platform deck using shovels to break off sections of cake into bergs that are pulled onto the platform deck and are broken up for mixing with water into a slurry that is pulled through ports in the platform sides for pumping through hoses.
Figure 7:
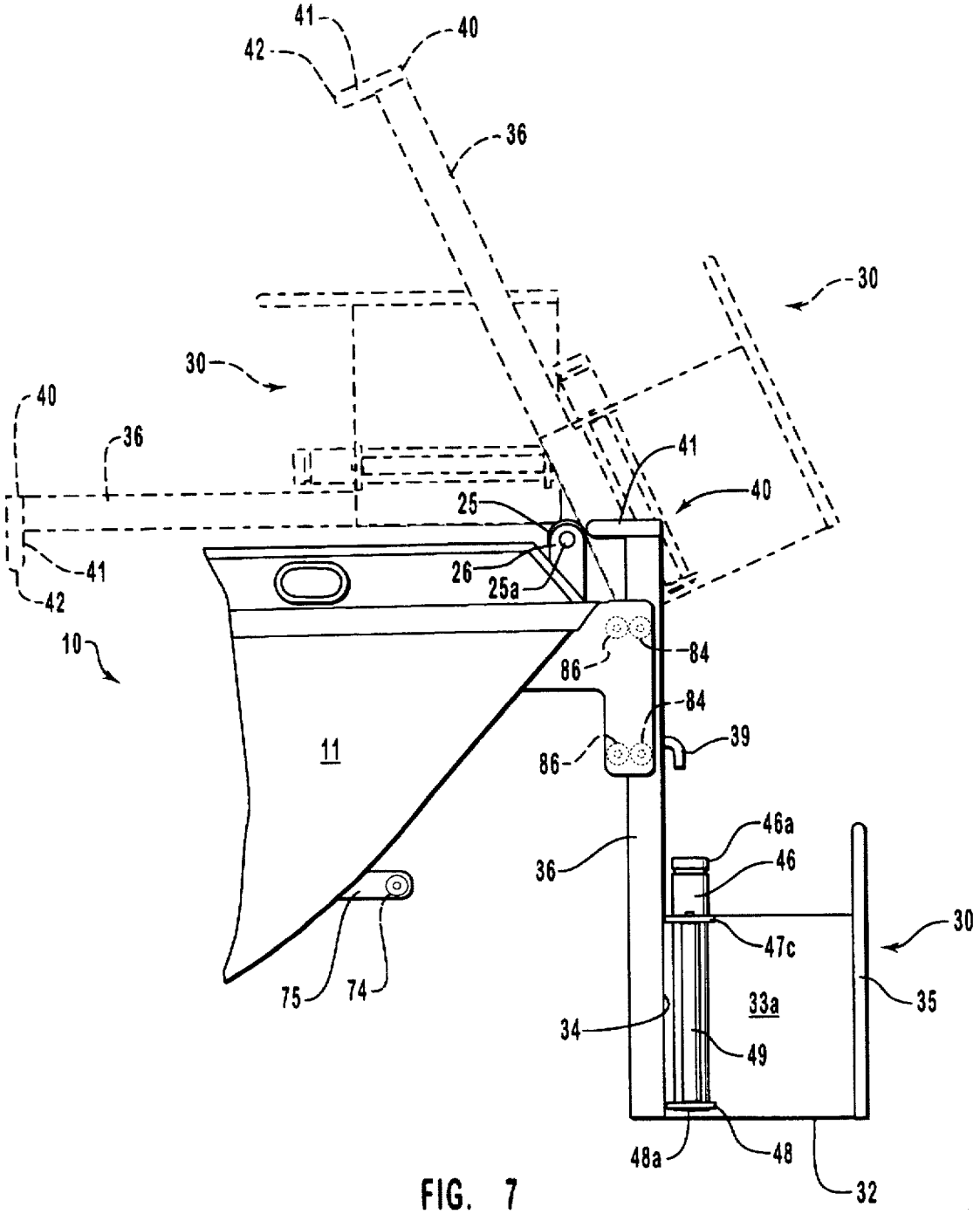
FIG. 7 is a side elevation view of the boat bow with the platform maintained thereon as shown in FIG. 3, and showing, in broken lines, the platform as being pulled by the end of a winch cable over the boat horizontal roller.

The platform 30, as shown in FIGS. 3, 6 and 7, and best in FIG. 5,. is preferably formed from sections of sheets of a light weight strong metal material, such as a ⅛" plate aluminum, that are connected together, as by welding, into a flat bottom or deck 32. Side walls **33*a* and 33*b* are secured to extend at right angles upwardly from along opposite deck edges, and a rear wall 34 is secured along a deck rear edge to extend at a right angle therefrom. Which side and rear walls 33*a*, 33*b* and 34 are connected together, as by welding, along their common or shared edges. The deck, side and rear walls form a rectangular box that is open across the top and a front portion, and a forward rail 35, shown as having a U-shape, is secured along the rail sides to the forward edges of sides walls 33*a* and 33*b*. The rail 35 is provided to protect workers from falling forward off of the platform deck 32**, as illustrated in FIG. 6.

A pair of like channels 36 and 37 are secured, in spaced apart parallel arrangement as by welding, to a back face of the rear wall 34. The channels, as shown, extend across the rear wall from a lower edge to extend beyond the top edge **34*a*. Shown best in FIGS. 5 and 6, the channels 36 and 37 each include parallel spaced sides that are separated by a web, with both sides, above the platform rear wall, shown as including pairs of aligned spaced holes 38 formed therein, which pairs are for receiving at least one pin 39 fitted through the aligned holes 38. Pin 39 is shown exploded away from the channels in FIG. 5, and installed in holes 38 in FIGS. 6 and 7. So arranged, each pin 39 is to pass above a roller, as set out and discussed herein below, the 39 pin supported on the roller to maintain the platform 30 suspended from the boat 10 bow 12. Further, for limiting travel of the platform 30 through bracket mounts 80 and 81, as set out below, pins 39 can be fitted through a pair of holes 38 in each channel to block travel of the platform when it is lowered into water 17**.

A U-shaped handle 40, that includes parallel legs 41 and a web 42, is attached to the top ends of the channels 36 and 37, as by welding end sections of the parallel legs 41 across the channel 36 and 37 top ends, as shown in FIGS. 1 through 3 and 5, and 6, and in both solid and broken lines in FIG. 7. The web 42 can be manually maintained by a worker or workers to manipulated the platform 30 onto and off of the roller 25 when the platform is lowered into and lifted out from the water 17, facilitating platform handling.

As shown best in FIG. 5, a pair of identical flow manifolds 45, that are shown as straight tubes 46, are secured along the platform side walls 36 and 37, proximate to their junctions with the edges of the rear wall 34. To provide which mounting, a tube top end portion of each tube 46 is fitted through a hole 47*a* formed through an upper bracket 47. The upper bracket 47 is secured along a base edge 47*b* to extend at a right angle outwardly from top edges of each of the side walls 36 and 37. A bottom portion of each straight tube 46 is secured to a lower bracket 48 that, in turn, is secured along its base to extend at a right angle outwardly from the lower portions of each of the side walls 36 and 37. The upper and lower brackets 47 and 48, respectively, provide for securely vertically mounting each manifold 45 alongside the outer surface of each of the platform side walls 36 and 37. Further, the upper and lower brackets 47 and 48, respectively, are formed with opposing apex end portions 47*c* and 48*a*, respectively, that includes holes 51 to receive pivot ends 50 that extend at right angles outwardly from the center of ends or a straight boom roller 49. The straight boom rollers receive an end of a harvesting boom 65 that is fitted thereunder, as shown in FIG. 6, the boom to across the roller 49, as shown in FIG. 6, with the boom roller 49 to turn freely to allow the harvesting boom 65 to travel thereacross, as set out and described hereinbelow with respect to FIGS. 2 and 6.

Figure 2:
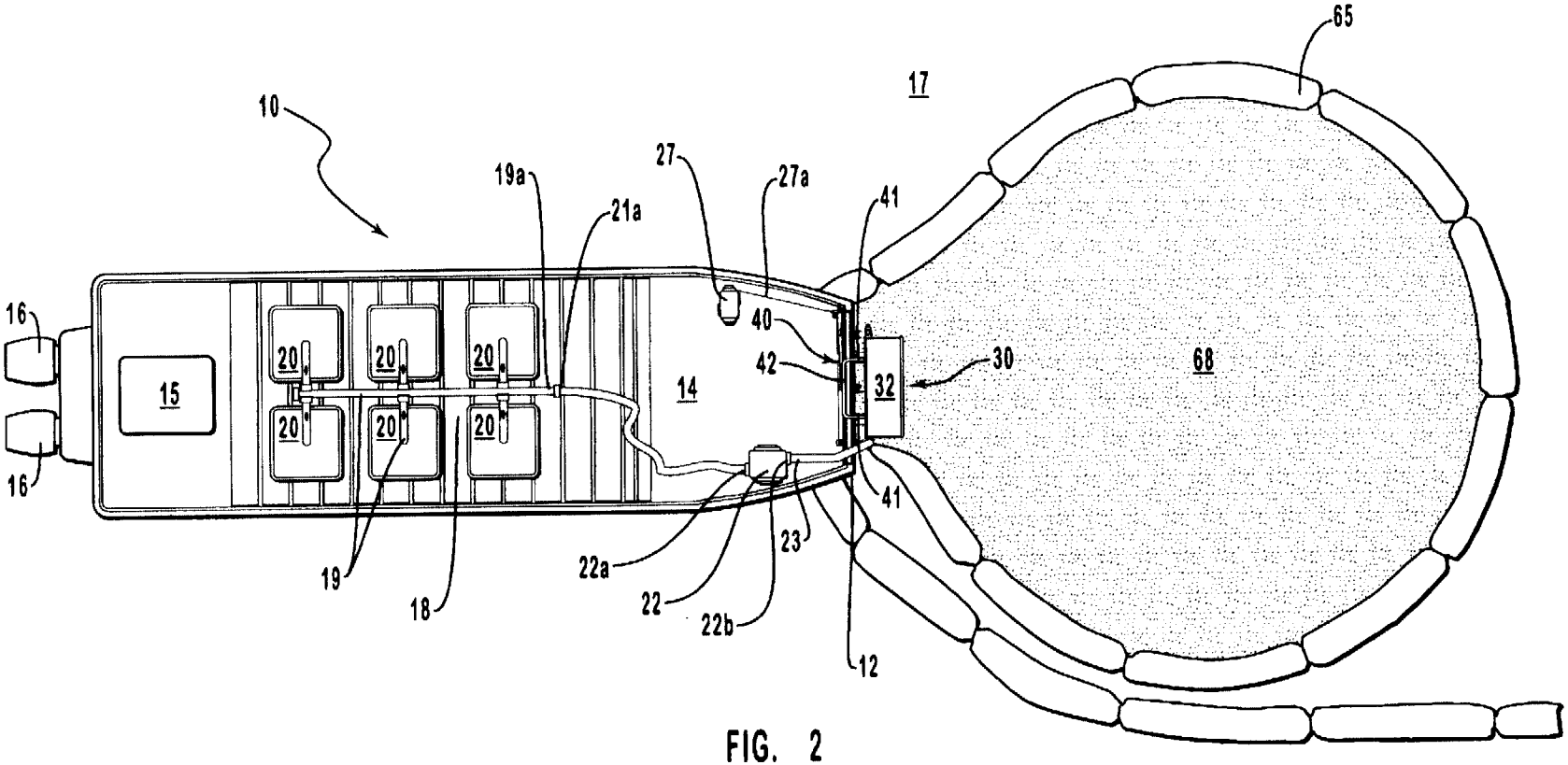
FIG. 2 is a top plan view of the boat of FIG. 1 that shows the platform as having been lowered over the boat and maintained in the water and showing a boom as having been connected at one end to the back of the platform rear face, with the other boom end shown as passed across and vertical rollers journaled to the platform sides, the boom shown as formed into a closed circle from the boat bow.

Shown in FIG. 5, a straight tube 46 of the harvesting manifold 45, proximate to its lower end, connects to a feed pipe 52 that is secured, on one end to fit into the tube 46, forming a right a right angle thereto. Feed pipe 52 provides and open passage into the straight tube 46. The feed pipe 52 end opposite to its connection into the straight tube 46 is secured across an opening or port 53 formed through each of the side walls 36 and 37, proximate to top surface of the deck 32. So arranged, a slurry of brine shrimp eggs and water that is collected on the platform deck 32 is pulled through a port or ports 53 by operation of the vacuum pump 22 maintained on the boat deck 14, as shown in FIG. 1. The slurry is pulled through the harvesting manifold and into vacuum line 23 that is secured, at end 23*b* as shown in FIG. 6, to a top end 46*a* of the straight tube 46. The straight tube top end 46*a*, as shown in FIG. 5, is preferably grooved to receive a clamp fitted over the vacuum tube end 23*b* that is cinched into that groove, for locking tube end 23*b*, shown, in FIG. 6, onto the straight tube top end 46*a*. While a single vacuum line 23 is shown installed to the harvesting manifold 45 that is secured to side wall 33*a*, as shown in FIGS. 1, 2 and 6, and is connected on its opposite end 23*a* to an inlet side of the vacuum pump 22, as shown best in FIG. 1, it should be understood that both manifolds 45 can be connected to vacuum lines 23 that, in turn, each connect to vacuum pump 22 or to two vacuum pumps, to simultaneously pull the slurry through both ports 53, within the scope of this disclosure. So arranged, that slurry will ultimately travel into the manifold system 18 and is passed into the porous bags 20.

As set out above, lowering of the platform 30 into water 17 is preferably accomplished manually but is controlled by operation of the winch 21, as shown in FIG. 1, that is operated to lift the platform out of the water, to turn a reel to wind winch cable 27 onto or off of the reel, with the winch cable 27 including a hook 27*a* secured to its end. The hook 27*a* is, as set out above, is for fitting into the opening 31*a* formed through the tab 31 that extends upwardly from the platform rear wall 34 edge 34*a*. The winch 21 is preferably mounted to the boat deck 14 with the winch cable 27 to reel off from or onto the winch reel, as shown in FIG. 3, and is passed over a first platform guide roller 60. The guide roller 60 is secured to turn parallel to deck 14, with the winch cable also fitted to travel over a second platform guide roller 61 that is approximately aligned with the center of horizontal roller 25, to also turn parallel to deck 14. From the second platform guide roller 61 the winch cable is passed over a bow platform roller 62 that is journaled or pivotally mounted between parallel plates 63*a* and 63*b* that extend at right angles outwardly from the boat bow 12. So arranged, to lift the platform 30, the winch cable 27, as shown in FIG. 3, is passed across the first and second platform guide rollers 61 and 62, and under the horizontal roller 25. With the hook 27*a* then fitted through the hole 31*a* formed through the platform tab 31. To control lowering of the platform 30 into the water, the hook 27*a* that is attached to the end of winch cable 27 and is passed across the horizontal roller 25, with the cable reeled out while the platform rear wall 34 is manually positioned onto the horizontal roller by the workers lifting the platform thereon and manually lowering it to where the channels 36 and 37 travel into bracket mounts 80 and 81. Accordingly, with the workers holding onto the platform handle 40 at web 42 the platform is allowed to roll over the horizontal roller 25, during which passage the slack in the winch cable 27 is taken up, controlling platform lowering, to where, after passage over the roller, the platform will be approximately perpendicular to the surface of water 17. The platform channels are then fitted into the bracket mounts and the winch cable further reeled out to lower the platform into the water to a desired depth. Whereat the platform is pinned in place, as set out above and further discussed hereinbelow. Raising the platform 30 out of the water 17 is the reverse of the above. After pin 39 removal, the platform the workers who grasp the handle 40 web 42, and with the hook 27*a* fitted through tab 31 hole 31*a* approximately aligning with the roller 62, the worker or workers assist in lifting the platform 30 by pulling upwardly on handle 40 and the winch 27 is operated to reel cable 27. The platform rear wall 34 thereby travels onto the horizontal roller 25 surface, rolling thereacross, and whereafter the workers manually reposition the platform onto the boat deck 14, as illustrated in the solid and broken line representations in FIG. 7, after disconnecting the hook 27*a* out from tab 31 hole 31*a*.

In addition to providing for controlling lifting and lowering of the platform 30 into and out of water 17, the winch 21 is useful also for assisting in pulling in the boom 65 to provide a final reduction of the boom radius that floats in water 17, for harvesting, as shown in FIG. 2. In practice, an inside tail 66 of boom 65 is secured to the back face of the platform 30 rear wall 34, and the other or outside tail 67 of boom 65 is moved, as by a separate boom boat, not shown, through water 17 to surround a slick, streak, or bloom of brine shrimp eggs, and that boom radius is slowly reduced by boom boat movement and manually. The boom toil 67 is passed across the boom rollers 49, as shown in FIG. 2. The boom outside tail 67 is shown moved across both the boom rollers 49, to float free in the water 17, until the boom circle is closed so as to concentrate the brine shrimp eggs into a thick cake 68, as illustrated in FIG. 6. The cake 68 is then drawn onto the platform deck in sections or bergs that are broken therefrom, as shown in FIG. 6. The sections or bergs are drawn onto the platform deck by a worker or workers 69 using tools, such as shovels 70, rakes, or the like, who break off sections or bergs of the cake 68 that are then pulled onto the platform deck 32 whereat the cake materials are re-watered as by the workers who, as with their feet, break up the bergs to mix the berg material with water, forming a slurry. This slurry they then directed into ports 52 and 53, for pumping, by operation of the vacuum pump 22, and ultimately flows into bags 20.

To utilize the winch 21 and winch cable 27 for pulling the boom 65 outside tail 67 across the boom rollers 49, a series of spaced eyelets, not shown, are formed at intervals along the boom 65 outer surface to individually receive the end of hook 27*a* fitted therein. The winch cable 27 and connected hook 27*a* are positioned to draw in a section of the boom 65 through the boom rollers by upon operation of the winch 21 to wind in the winch cable 27 onto the winch reel. As the last phase of closing the boom 65, a boat or a man in the water pulls the winch cable and hook out into the water and attaches it into a boom eyelet. Whereafter, by operating the winch 21, the winch cable is reeled in to pull the boom section up to the connected eyelet across first one boom roller 49, with the boom tail to pass also across the other boom roller 49, as shown in FIG. 2, concentrating the eggs contained within the boom into a thick cake.

Port and starboard pulley system are provided to position the winch cable 27 to properly draw the boom 65 across the respective boom rollers 49, with, depending upon how the boom is set up, the boom 65 outside tail 67 either traveling from port to starboard or starboard to port. The port pulley system shown in FIG. 3, includes first and second boom guide pulleys 71 and 72 respectively whereover the winch cable 27 is passed to align with a port side bow pulley 73. The port side bow pulley 73 is journaled between plates 74*a* and 74*b* that are secured in spaced parallel arrangement to extend at right angles outwardly from bow 12. The winch cable 27 will passes over the bow pulley 73 and under a port directional pulley 74 that is journaled between spaced parallel plates 75 that are secured to extend outwardly from the boat bow 12, below the bow pulley, as shown in FIGS. 6 and 7. So arranged, the winch cable 27 is pulled through the directional pulley 74 to move a section of the boom 65 towards that pulley. Whereafter, after removal of tension off from the winch cable 27, the winch cable hook 27*a* is disconnected and is reset into another boom eyelet along the boom outer surface. The winch 21 is then operated to again slowly pull in the winch cable, pulling another section of the boom towards and across the boom vertical rollers 49.

As shown in FIG. 3, as part of a starboard pulley system, the winch cable 27 is first past over the pulley 60 that is used also as part of the pulley arrangement for assisting in lifting and lowering the platform 30, as set out above. Therefrom, for the starboard pulley system, the winch cable passes over a starboard boom guide pulley 76 that is journaled to boat deck 14 and thence over a starboard side boom pulley 77 that is journaled between spaced parallel plates 78*a* and 78*b* that are secured to extend at right angles outwardly from boat bow 12. The port and starboard sides boom pulleys 73 and 77 are alike and function identically. Also, a starboard directional pulley, not shown, that is like the port directional pulley 74, and is arranged to and function like the described port directional pulley 74 for providing for directing the winch cable 27 thereunder to pull in sections of the boom 75 as shown in FIG. 2 and so will not be further described herein.

The function and operation of the combination of the horizontal roller 25 with the utilization of the winch 21 and winch cable 27 and providing for fitting of the winch cable hook 27*a* into the hole 31*a* through platform tab 31 for assisting in raising the platform 30 out from and lowering it into water 17 has been set out and described hereinabove. For further guiding platform 30 travel, bracket mounts 80 are secured parallel to one another to extend outwardly from the surface of boat bow 12, as shown in FIGS. 3, 6 and 7. Each bracket mount 80 consists of a pair of plates 81 that each include a right angle flange 82 formed along one edge that conforms to the slope of the boat bow 12 and includes attachment holes 82*a*, shown in FIG. 6, formed therealong for receiving fasteners, not shown, for connecting the flanges 82 to the boat bow. Each of the pair of bracket mounts 80, plates 81 are spaced apart, with the flanges 82 aligning and pointing oppositely. The plates 81 are spaced apart for maintaining platform channel guide rollers 83 journaled therebetween to support the legs of platform channels 36 and 37 passing therebetween. At least one pair and preferably a plurality of pairs of platform channel guide rollers 83 are journaled to each bracket mounts 80, between plates 81 thereof. So arranged, each of the pair of platform channels 36 and 37 will pass between opposing surfaces of individual inner and outer rollers 84 and 86, respectively, as shown best in FIG. 4. Inner roller 84, as shown, is nearest to boat bow 12 and is journaled on axle 85 that extends across the bracket parallel plates 81, and the outer roller 86 is journaled on an axle, not shown, secured to extend at a right angle from an inner plate 81 of the pair of plates 81, and includes a stop end 87 that is secured to the unconnected axle end to remain stationary as the roller 86 turns. So arranged, a pin 39 that is passed through the pair of aligned holes 38 formed through the channel 37 parallel sides 37*a* and 37*b*, shown in FIGS. 4 through 7, will pass above the stop end 87, as shown best in FIG. 7. Thereby, with the pins 39 positioned above the stop end 87, the platform is supported to the boat bow, allowing the winch cable 27 to be released, with the platform 30 weight supported by the engagement of the stop end 87 of each of the pair of platform channel guide rollers 83 supporting pin 39.

Figure 4:
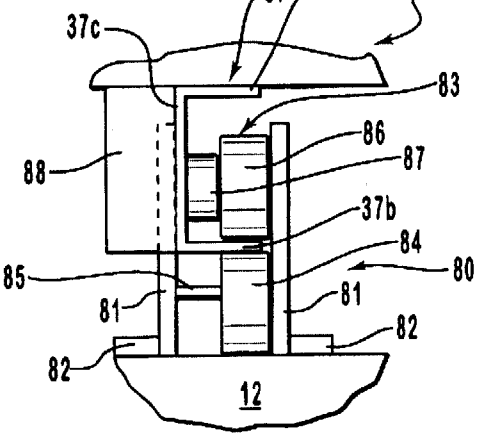
FIG. 4 is a enlarged top plan sectional view taken within in line 4—4 of FIG. 3, showing a pair of rollers maintained across parallel plate sides of a bracket, between which pair of rollers a side of a channel is passed whose oppose side is secured to a back of the platform rear wall.

Two pairs of inner and outer rollers 84 and 86 are shown in broken lines in FIG. 7 that are journaled, as set out above, in the open area between the plates 81 of each of the brackets mounts 80. One pair of rollers is shown proximate of the plate 81 top edge and the other of the pair of rollers is shown proximate to the plate 81 lower edge. Accordingly, while one such pair of rollers 84 and 86 could be used to guide and support the platform channel side 37*b* passed therebetween, as shown in FIG. 4, at least a pair of the platform channel guide rollers 83 is preferred for each bracket mount 80. Further, for prohibiting the channels 36 and 37 from traveling past the bracket mounts 80, top plates 89 are preferably secured to extend at right angles outwardly from the outer surface of guide channel webs 37 to engage an outer portion of a top edge of an outer plate 81 of each bracket mount 80. Alternatively, a pin 39 fitted through a top pair of channel holes 38 can also provide such stop arrangement.

With the platform 30 supported to the bracket mounts 80, the winch cable 27 can then be restrung, as described above, through the respecting port of starboard pulleys and the winch cable hook end 27*a* connected to a boom eyelet to pull a section of the boom 65 across the boom rollers 49.

While a preferred embodiment of my invention and its use for harvesting brine shrimp eggs off from a body of water utilizing a boom to concentrate the eggs into a cake has been shown and described herein, it should be understood that the present disclosure is made by way of example only and that the invention may be differently configured and its use varied from that shown and described without departing from the subject matter coming within the scope of the following claims, and a reasonable equivalency thereof, which claims I regard as my invention.

I claim:

1. A platform and system for maintaining and supporting it to a boat for use with a boom for harvesting a life form or substance found in a body of water comprising, a platform having a flat deck, upstanding sides secured to said deck, and an upstanding rear wall; at least one port formed through one of said sides or rear wall that connects to and is open into a harvesting manifold body; a harvesting manifold body that connects, respectively, to said port and is for connection to an end of a harvesting hose; a harvesting hose that is open therethrough and connects, respectively, to said harvesting manifold body and to a means for pulling a slurry passed from said harvesting manifold body for delivery into a container means; bracket means secured to extend from said platform, side, sides, or rear wall for mounting said harvesting manifold body and for vertically pivotally mounting a straight boom roller thereto; at least one guide means secured to extend from said platform rear wall and projects at a right angle outwardly from a rear wall top edge; a locking means for mounting said guide means to at least one bracket means; at least one bracket means for mounting to extend outwardly from a harvest boat and is arranged to receive and pass said guide means therein and, with said locking means, maintains positioning of said guide means to said bracket means; and winch means arranged to reel in a winch cable, with pulley systems for guiding said winch cable to alternatively assist in raising or lowering said platform, or to move a conventional boom across said straight vertical boom roller; and means for connecting, respectively, an end of said winch cable to said platform or to said conventional boom.

2. A platform and system as recited in claim 1, wherein the deck, sides and rear wall are rectangular sections that are joined along common edges into a rectangle that is open across front and top areas; and a pair of harvesting manifolds are mounted between the pair of bracket means that are attached to extend outwardly from said platform sides or rear wall that are open to each of a pair of ports and are connects, across open top ends, to a pair of harvesting hoses that, in turn, connect to at least one pump means.

3. A platform and system as recited in claim 2, wherein the pair of bracket means are flat sections that are spaced apart with each connected, along an edge to the platform side or rear wall, to extend beyond and at approximately a right angle from a cylindrical harvest manifold body outer surface with opposing points on each said pair of bracket means to serve as mounting points for mounting the straight vertical boom roller therebetween, slightly apart from said harvest manifold body outer surface.

4. A platform and system as recited in claim 1, wherein a pair of like straight guide means are secured in spaced parallel relationship, to extend from the platform rear wall, across and equally distant from a top edge of said rear wall, which guide means are identical channel sections, each having parallel sides connected to opposite edges of a flat web, and said channel sides have a plurality of spaced pairs of holes formed therethrough that align to receive a straight pin means fitted therebetween, with said holes and pin means constituting the locking means for supporting said guide means to the bracket means.

5. A platform and system as recited in claim 4, wherein a pair of bracket means are secured, in parallel spaced apart relationship, to extend outwardly from the harvest boat, with each said bracket means to each receive an end of one of the straight guide channels fitted into the top thereof, with each said bracket means includes a pair of identical plates that are each sloped along a plate edge to conform to a slope of a harvest boat surface whereto the bracket means is attached, with said plate edges each formed into a flange that includes spaced holes formed therethrough for receiving fastener means for securing each said plate to said harvest boat surface; and further including at least one pair of roller means journaled between opposing plate surfaces so as to pass a side of said guide channel.

6. A platform and system as recited in claim 5, wherein the plurality of space apart pairs of rollers are journaled between opposing plate surfaces, with a first roller of each pair that is closest to the harvest boat surface fitted to turn on an axle that is mounted to extend between said opposing plate surfaces and a second roller or each pair spaced outwardly from said first roller and is arranged to turn on an axle that is secured to extend at a right angle from one plate surface only, and includes a stop secured to said axle unconnected end spaced from the opposite plate surface a sufficient distance to allow the web of said guide channel to pass therebetween, which said stop is also to receive the pin means passed thereover between the guide channel side pair of aligned holes as the locking means for maintaining the platform onto the bracket means.

7. A platform and system as recited in claim 6, further including a plate means secured to extend outwardly from a top edge of each straight guide channel web opposite to the sides of said guide channel for engaging a bracket means plate top edge to block travel of said guide channel through said bracket means.

8. A platform and system as recited in claim 1, further including a horizontal roller journaled to the harvest boat adjacent to the side wherefrom the bracket means extends.

9. A platform and system as recited in claim 1, wherein the means for connecting an end of said winch cable to said platform is a tab secured to extend upwardly from a midpoint of said platform rear wall that includes a hole formed therethrough for receiving a hook that is secured onto a winch cable end; and including a pulley means secured to said harvest boat whereover said winch cable is passed to align said cable end with said platform tab for assisting in lifting or lowering said platform during operation of the winch to reel in or reel out said winch cable.

10. A platform and system as recited in claim 9, wherein the pulley means is a deck pulley that is journaled to the harvest boat deck whereover the winch cable is passed, to redirect said winch cable travel to a location immediately above and aligned with a platform pulley; and a platform pulley journaled between mounting plates that extend outwardly from said harvest boat above a location whereat the platform is lowered into and raised out from the water.

11. A platform and system as recited in claim 10, wherein the pulley means for connecting an end of said winch cable to the conventional boom is a port or starboard boom pulley means that includes at least a first deck pulley whereover the winch cable is passed, to redirect said winch cable to a location immediately above and aligned with a port or starboard boom guide pulley; a boom guide pulley that is journaled between mounting plates that extend outwardly from said harvest boat at a location that is opposite to either a port or starboard harvesting manifold and straight boom roller, with said boom guide pulley spaced apart from the harvesting boat a distance to allow a connector as is secured to the winch cable pulley to pass therebetween; a connector secured to said winch cable end; and connection means arranged along an outer surface of the conventional boom to receiving and releasably connect to said winch end connector.

12. A platform and system as recited in claim 11, further including both port and starboard boom pulley means are mounted to, respectively, the harvest boat port and starboard sides.

* * * * *

UNITED STATES PATENT AND TRADEMARK OFFICE
CERTIFICATE OF CORRECTION

PATENT NO. : 5,738,036

DATED : April 14, 1998

INVENTOR(S) : Nathan Jones

It is certified that error appears in the above-identified patent and that said Letters Patent is hereby corrected as shown below:

In the Abstract, line 24, after the word "and" delete "raise" and add --raising--; and line 29, delete the first word "for" and add --to--.

In the Background of the Invention, at column 1, line 44, after the word "ergonomics" add --of--; line 45, before the word "that" add --are such--; line 47, delete the first word "clam" and add --calm--; and line 65, after the words "that are" delete "removal" and add --removable--. At column 2, line 17, after the word "pull" add --and--; line 29, after the word "Pat." delete "No."; line 29, after the word "Dodge," add --No.--; and line 53, after the word "used" delete the word "against".

In the Summary of the Invention, at column 3, line 11, delete the word "supports" and add --supporting--. At column 4, line 9, after the word "practice," delete "to lower"; line 9, after the word "hand" add --connecting--; line 10, delete the first word "with" and add --to--; line 10, after the word "end" delete "connected thereto as a safety"; line 11, delete the first word "wire"; and line 51, after the word "during" add --a--.

In the Detailed Description, at column 7, line 65, after "27a" delete "is". At column 8, line 55, after the words "The boom" delete "toil" and add --tail--. At column 9, line 2, after the words "This slurry" delete "they" and add --is--; line 11, delete the first word "through" and add --across--; line 11, after the word "by" delete "upon"; and line 57, after the words "pulley 74" delete "for".

UNITED STATES PATENT AND TRADEMARK OFFICE

CERTIFICATE OF CORRECTION

PATENT NO. : 5,738,036

DATED : April 14, 1998

INVENTOR(S) : Nathan Jones

It is certified that error appears in the above-identified patent and that said Letters Patent is hereby corrected as shown below:

In the Claims, in Claim 5, at column 11, line 62, after the word "means" delete "includes" and add --including--. In Claim 11, at column 12, line 60, delete the first word "receiving" and add --receive--.

Signed and Sealed this

Seventeenth Day of November, 1998

Bruce Lehman

*Attest:*

BRUCE LEHMAN

*Attesting Officer*

*Commissioner of Patents and Trademarks*